US009243806B2

(12) United States Patent
Cetintas et al.

(10) Patent No.: US 9,243,806 B2
(45) Date of Patent: Jan. 26, 2016

(54) GAS-FIRED KITCHEN APPLIANCE

(75) Inventors: Sakir Cetintas, Aalen (DE); Reinhard Krause, Mittenaar (DE)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 344 days.

(21) Appl. No.: 13/640,191

(22) PCT Filed: May 11, 2011

(86) PCT No.: PCT/EP2011/002328

§ 371 (c)(1),
(2), (4) Date: Feb. 21, 2013

(87) PCT Pub. No.: WO2011/147530

PCT Pub. Date: Dec. 1, 2011

(65) Prior Publication Data

US 2013/0199512 A1 Aug. 8, 2013

(30) Foreign Application Priority Data

May 27, 2010 (EP) ..... 10005482

(51) Int. Cl.

| | |
|---|---|
| ***F24C 3/12*** | (2006.01) |
| ***F23N 5/24*** | (2006.01) |
| ***F24C 15/12*** | (2006.01) |

(52) U.S. Cl.

CPC . *F24C 3/126* (2013.01); *F23N 5/24* (2013.01); *F24C 3/128* (2013.01); *F24C 15/12* (2013.01); *F23N 2041/08* (2013.01)

(58) Field of Classification Search

CPC ..... H01H 3/162; H01H 3/161; F24C 15/023; F24C 3/103; F24C 5/14; F24C 15/02; F23Q 3/008; F23C 2700/063; F23D 11/42; F23D 2207/00

USPC ..... 126/39 BA; 200/61.62

See application file for complete search history.

(56) References Cited

U.S. PATENT DOCUMENTS 829,515 A * 8/1906 Dunkel ..... 200/61.8
2,881,830 A * 4/1959 Leins ..... 431/47

(Continued)

FOREIGN PATENT DOCUMENTS

| | | | | |
|---|---|---|---|---|
| GB | 2182136 | | 5/1987 | |
| GB | 2182136 | A * | 5/1987 | ..... F24C 3/12 |
| GB | 2182137 | | 5/1987 | |
| GB | 2186720 | | 8/1987 | |

(Continued)

OTHER PUBLICATIONS

International Search Report for PCT/EP2011/002328, dated Nov. 18, 2011, 3 pages.

*Primary Examiner* — Steven B McAllister
*Assistant Examiner* — Rabeeul Zuberi
(74) *Attorney, Agent, or Firm* — Pearne & Gordon LLP

(57) ABSTRACT

A gas-fired kitchen appliance, comprises (a) a food preparation zone (10); (b) a burner nozzle (12) for supplying heat to said food preparation zone (10); (c) an electromagnetic valve (16) which when energized allows gas to be supplied to the burner nozzle (12) and which when deenergized blocks the gas supply to the burner nozzle; (d) a thermocouple (32) located in proximity of the burner nozzle (12), the thermocouple when heated energizing the electromagnetic valve (16); (e) a cover element (36) associated to said food preparation zone (10), said cover element being movable between a first position which allows normal operation of said food preparation zone and at least one second position in which said food preparation zone is non-operable or idling; and (f) a switching element (34) associated to said cover element (36) and arranged to interrupt the supply of electric energy from the thermocouple (32) to the electromagnetic valve (16) when the cover element (36) is in said second position.

17 Claims, 5 Drawing Sheets

(56) References Cited

U.S. PATENT DOCUMENTS

| | | | | | |
|---|---|---|---|---|---|
| 3,766,905 | A | * | 10/1973 | Sekera, Jr. | 126/42 |
| 4,385,724 | A | * | 5/1983 | Ramsauer et al. | 236/25 A |
| 5,600,976 | A | * | 2/1997 | Hapke et al. | 68/12.26 |

FOREIGN PATENT DOCUMENTS

| | | | | | |
|---|---|---|---|---|---|
| GB | 2186720 | A | * | 8/1987 | F24C 3/12 |
| GB | 2344877 | | | 6/2000 | |
| GB | 2344877 | A | * | 6/2000 | F24C 15/12 |

* cited by examiner

GAS-FIRED KITCHEN APPLIANCE

The present invention relates to a gas-fired kitchen appliance, such as a gas range comprising one or more cooking sites or a gas oven having an oven muffle which is heated by a plurality of gas flames.

In such devices, care has to be taken that the supply of gaseous fuel is shut off in certain circumstances. In particular, the gas supply should be interrupted when there no longer is a burner flame, be it because the user had intended to turn off the burner or in case that the burner flame inadvertently was extinguished for example by water boiling over a cooking pot and wetting the burner nozzle, so as to avoid the escape and accumulation of large amounts of gas which involves the risk of an explosion.

To this end, in WO 2010/039439 it had been suggested to provide a thermocouple in proximity of the burner nozzle, wherein the thermocouple generates an electric current when the burner is hot. In this manner a signal is provided which is indicative for a burner flame being present.

Furthermore, care should be taken that for example in a gas range which comprises a cover element for covering the cooking sites, all the burner nozzle associated to the cooking sites are extinguished and their gas supply shut off if the cover element is closed, so as to avoid inadvertent overheating of the cover element when the latter is closed while a burner flame still is burning.

In the prior art attempts had been made to solve this latter problem by providing for additional safety valves that were mechanically coupled to the cover element and by which the gas supply to the burners could be turned off when the cover was closed. Such a solution is disadvantageous it that it is complicated and thus is prone to failure and leakage of gas.

It is an object of the present invention to provide for a gas-fired kitchen appliance, in which the operational safety of the appliance is further improved and which yet is less complex than the prior art solutions.

The above object is solved by the present invention which is a gas-fired kitchen appliance comprising:

- a food preparation zone;
- a burner nozzle for supplying heat to said food preparation zone;
- an electromagnetic valve which when energized allows gas to be supplied to the burner nozzle and which when de-energized blocks the gas supply to the burner nozzle;
- a thermocouple located in proximity of the burner nozzle, the thermocouple when heated energizing the electromagnetic valve;
- a cover element associated to said food preparation zone, said cover element being movable between a first position which allows normal operation of said food preparation zone and at least one second position in which said food preparation zone is non-operable or idling; and
- a switching element associated to said cover element and arranged to interrupt the supply of electric energy from the thermocouple to the electromagnetic valve when the cover element is in said second position.

In the kitchen appliance suggested herein, the burner nozzle is supplied with gas only if on the one hand, the thermocouple is heated and thus supplies energy to the electromagnetic valve and if on the other hand the switching element which is associated to the cover element is in a switching position which is representative for the cover element being in its normal operation position.

The kitchen appliance of the present invention thus provides in a single cost effective solution the safety features of shutting of the gas supply to the burner nozzle or nozzles in case that that the burner flame is advertently or inadvertently extinguished and of shutting of the gas supply to the burner nozzle or nozzles in case that the cover element is brought into a position which is indicative for the kitchen appliance no longer being in its normal operation condition.

Preferred embodiments of the present invention are defined in the dependent claims.

In particular, the electromagnetic valve may comprise a valve element for selectively opening and closing a gas supply line, means such as a spring, for biasing the valve element into the closed position, a manual switch arranged to move the valve element from the closed position to the open position against the biasing force of the biasing means and a solenoid which when energized maintains the valve element in the opened position. In this electromagnetic valve, the biasing means acts to cause the valve element to assume the closed position as soon as the solenoid no longer is energized, i.e. as soon as the electric supply line to the solenoid is interrupted. On the other hand, also when the solenoid is energized, the electromagnetic valve still requires a user to activate the manual switch so as to move the valve element from the closed position to the opened position. When connected to the thermocouple, the electromagnetic valve thus allows gas flow to the burner nozzle only if the thermocouple supplies energy, that is if the thermocouple is hot which is indicative for a burner flame being ignited, and only when the cover element is in the position of normal operation of the food preparation zone. Should the thermocouple be cold, for example when beginning a cooking operation, and hence does not deliver the energy that is required to maintain the electromagnetic valve open, gas flow is made possible by the user activating the manual switch so that the valve element is held in the open position until the thermocouple is sufficiently heated and thus provides to the solenoid the energy required to hold the valve element in the open position.

To facilitate operation of the burner, a spark generator can be provided in proximity of the burner nozzle so as to ignite a burner flame at the burner nozzle. In case that there are a plurality of burner nozzles, such as in a range which comprises a plurality of cooking sites, or in an oven comprising a plurality of burner nozzles which are arranged at a distance from each other and which hence need to be ignited individually, the spark generator can be designed to simultaneously generate sparks at all the burner nozzles, wherein burner operation only is initiated or continued at those burners to which gas is supplied. While individual controls can be provided for activating the spark generator and the manual switch of the electromagnetic valve, so as to provide for a further fail-safe feature in that the user has to activate two separate controls, the spark generator also can be coupled to the manual switch. In the latter case, start-up of a burner operation is facilitated because the user only has to activate the manual switch of the electromagnetic valve which thus initiates gas flow to the burner and which at the same time causes the spark generator to ignite the gas ejected from the burner so as to establish a burner flame.

As noted above, in kitchen appliances comprising a plurality of burner nozzles to each of which there is associated an electromagnetic valve and a thermocouple the switching element can be designed to cause interruption of the gas supply to all the burner nozzles. This can be implemented by arranging the switching element so as to interrupt the supply of electric energy from each of the thermocouples to the respective electromagnetic valve when the cover is in the second position in which the food preparation zone is non-operable or idling. Alternatively, to each of the burner nozzles there can be associated a relay which is arranged in the line supplying electric energy from the respective thermocouple to the respective electromagnetic valve, wherein the switching element is arranged to trigger each of the relays to interrupt the supply of electric energy when the cover element is in the second non-operation position.

If the food preparation zone is a cooking site of a gas range, the cover element can be a cover plate for the cooking site, such as a pivotable lid that is hinged to the kitchen appliance, wherein the switching element is activated when the lid is displaced from the fully opened position by a certain angle.

In order to activate the switching element, a cam member can be connected to the cover element, for example close to the pivot axis of the cover element, which cam member operates the switching element in dependency of the positioning of the cover element.

In embodiments wherein the food preparation zone is a muffle of a gas oven, the switching element can be arranged to interrupt the operation of a burner nozzle in dependency of the position of a door for said muffle. Thus, when there are provided plural burner nozzles for heating the interior of the oven muffle, the gas supply to such burner nozzles can be interrupted if the door of the oven is opened.

To this end the switching element can be coupled to a hinge mechanism for said door such that the supply of electric energy from the thermocouple to the electromagnetic valve of the respective burner nozzles is interrupted when the door is in an opened position. In order to allow an operator to open the door by a certain extent, for example so as to check the condition of any food which is prepared within the oven muffle, the switching element can be arranged so as to interrupt operation of the burner nozzles when a certain opening angle of the door is reached, for example when an opening angle of 55° is reached.

In embodiments in which the switching element is coupled to a hinge mechanism of the muffle door, the hinge mechanism can comprise a member which during movement of the door is subject to a substantially linear movement, and wherein the switching element is coupled to the hinge mechanism by a clip that is attached to the linearly moving member. In order to translate the linear movement of the clip into a pushing action on a push button of the switching element, the clip comprises a slanted switching surface engaging the push button. Considering that many of the gas ovens presently on the market comprise hinge mechanisms with means for balancing the weight of the oven door wherein the balancing means comprises a member which during opening the oven door is linearly moved so as to act on a spring mechanism for balancing the weight of the door, such a clip can be employed for providing already existing kitchen appliances with means for interrupting the gas supply to the burner nozzles in dependency of the position of the oven door.

Preferred embodiments of the present invention will be described by reference to the drawings in which.

Figure 1:
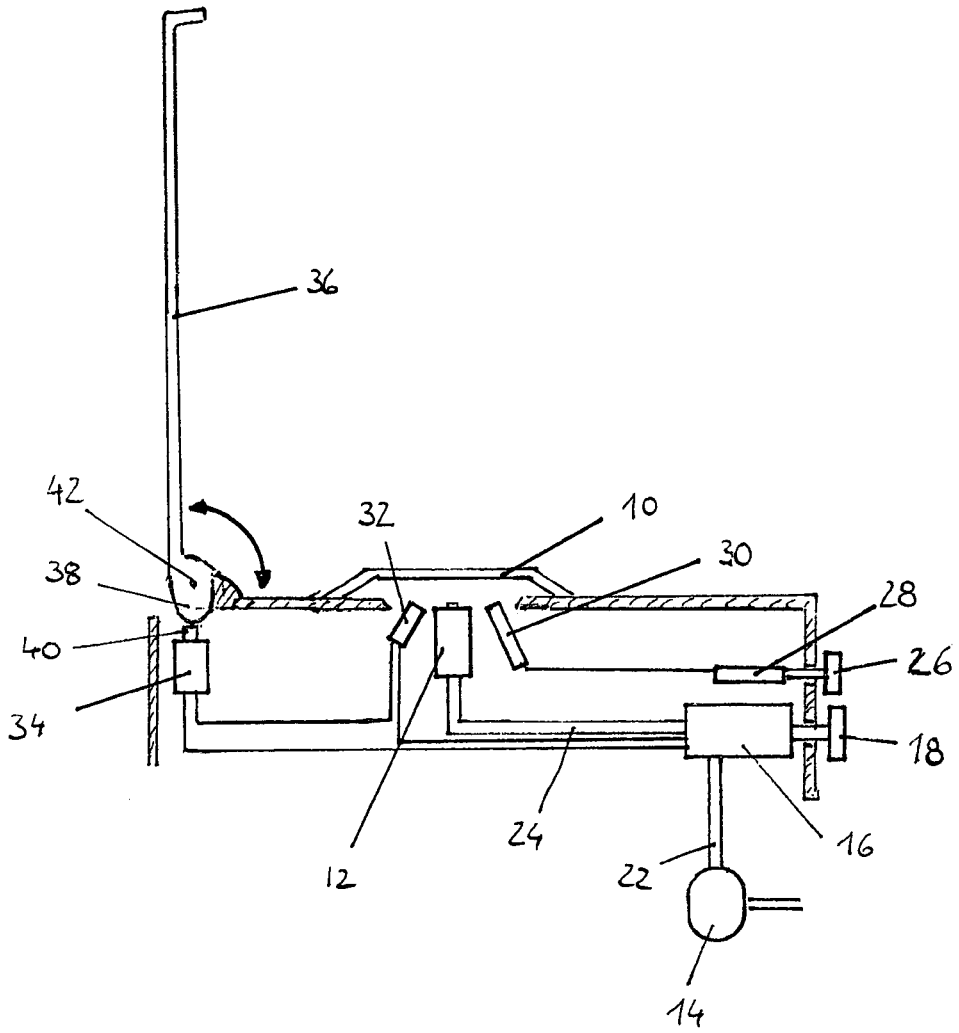
FIG. 1 is a schematic sectional view of a gas range made in accordance with the present invention.

In FIG. 1, there is shown a schematic sectional view of a gas range comprising a cooking site 10 which can be heated by means of a burner nozzle 12. Gas is fed to burner nozzle 12 from a gas manifold 14 via an electromagnetic valve 16, operation of which will be explained in further detail below by reference to FIGS. 2 to 7. Gas manifold 14 is connected to a gas supply, such as a gas cylinder or a domestic gas pipe. While electromagnetic valve 16 preferably includes a gas regulator for metering the amount of gas which is passed from manifold 14 to burner nozzle 12, in order to simplify the description of the present invention electromagnetic valve 16 is herein as a shut-off valve, by means of which the supply of gas from manifold 14 to burner nozzle 12 can be interrupted.

In order to start gas flow from manifold 14 to burner nozzle 12, an operator pushes a manual switch 18 so as to open a valve element 20 (see FIGS. 2 to 7) which opens a connection between inlet line 22 via which electromagnetic valve is connected to manifold 14 and outlet line 24 by means of which the electromagnetic valve 16 is connected to burner nozzle 12. In order to ignite the gas ejected from burner nozzle 12, the user presses a push button 26 of a switch 28 so as to supply electric energy to a spark generator 30 which is located in proximity to burner nozzle 12. The presence of a flame at burner nozzle 12 is detected by means of a thermocouple 32 which is located in proximity of burner nozzle 12 and which when heated generates an electric current. Current from thermocouple 32 is supplied, via a switching element 34, to electromagnetic valve 16.

In the embodiment shown in FIGS. 1 to 7 switching element 34 is a circuit breaker which when activated interrupts the connection between thermocouple 32 and electromagnetic valve 16. Switching element 34 is associated to a cover element 36 which is hinged to the body of the gas range so as to be pivotable between a substantially vertical position which as shown in FIG. 1 allows normal operation of cooking site 10 and a substantially horizontal position in which cover element 36 covers cooking site 10.

For operation of switching element 34, a cam member 38 is associated to the hinge 42 of cover element 36, wherein cam member 38 is arranged to engage a push button 40 of the switching element 34. In the operational position shown in FIG. 1 when push button 40 is pressed, switching element 34 is activated and provides for an electrical connection between thermocouple 32 and electromagnetic valve 16. When cover element 36 is tilted towards the closed position, cam member 38 releases the pressure on push button 40 and thus deactivates switching element 34 so as to interrupt the supply of electric current from thermocouple 32 to electromagnetic valve 16.

Figure 2:
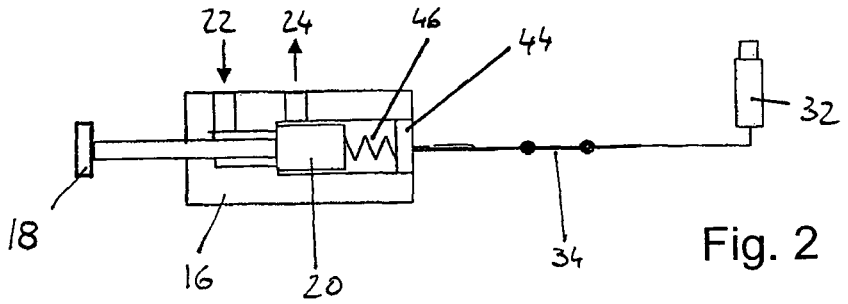
FIGS. 2 to 7 are schematic views illustrating various operational conditions of the electromagnetic valve and the switching element.

FIG. 2 is an enlarged view of electromagnetic valve 16 which is connected via switching element 34 to thermocouple 32. FIG. 2 shows an operational state wherein cover element 36 is opened so that cam member 38 presses push button 40 of switching element so as to close switching element 34. In this state, the connection between inlet line 22 and outlet line 24 is blocked because valve element 20 is biased into a closing position by means of a compression spring 46. Although switching element 34 is closed, solenoid 44 of electromagnetic valve 16 is not energized, because thermocouple 32 which has not been heated does not supply an electric current.

Figure 3:
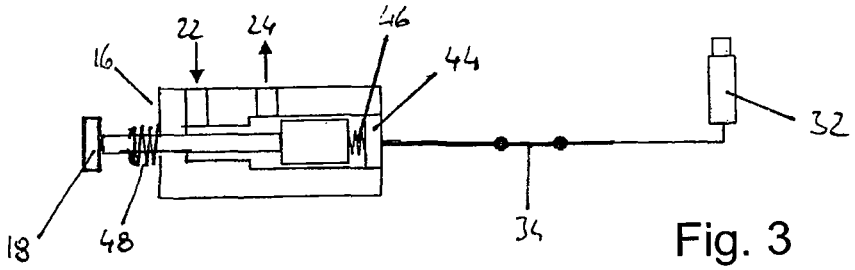
Figure 4:
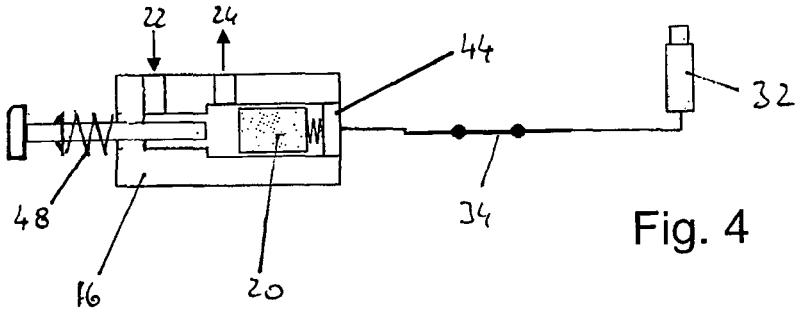

When the user wants to start up operation of burner nozzle 12, he has to press manual switch 18 and thus displaces valve element 20 against the biasing force of spring 46 into the position shown in FIG. 3 in which gas can flow from inlet line 22 to outlet line 24. At the same time, the user pushes push button 26 (shown in FIG. 1) so as to start spark generator 30 which then ignites the gas ejected from burner nozzle 12. Manual switch 18 is kept pushed for a few seconds so as to allow thermocouple 32 to sufficiently heat so as to supply the electric current required at solenoid 44 to maintain valve element 20 in the opened position against the biasing force of spring 46. When said heating time is elapsed, the user can release switch 18, which is returned into its initial position by a return spring which is illustrated in FIGS. 3 and 4 only. During normal cooking operation of burner nozzle 12 as it is shown in FIG. 4, solenoid 44 which is energized by thermocouple 32 thus maintains valve element 20 in the opened position in which it allows free communication between inlet line 22 and outlet line 24.

Figure 5:
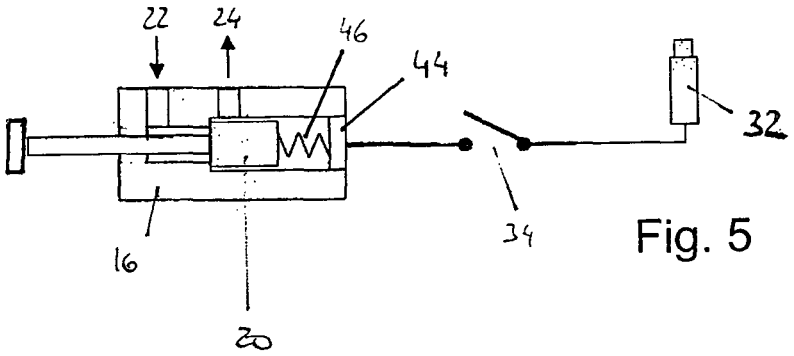

When cover element 36 is closed while burner nozzle 12 is still active, switching element 34 interrupts the connection between electromagnetic valve 16 and thermocouple 32, as it is shown in FIG. 5. Although thermocouple 32 still is hot and thus supplies an electric current, solenoid 44 nevertheless is de-energized so that valve element 20 is displaced into its closed position by means of biasing spring 46. Thus, the supply of gas to burner nozzle 12 is interrupted so as to extinguish the burner flame and thus prevent overheating of the closed cover element 36.

Figure 6:
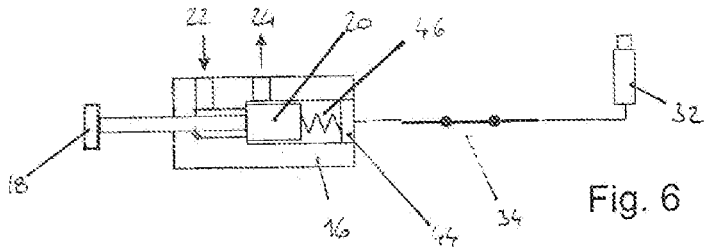

FIG. 6 shows the electromagnetic valve 16, switching element 34 and thermocouple 32 when the cover element 36 is opened again. Although due to the closing of cover element 36, switching element 34 again is closed and hence the connection between thermocouple 32 and electromagnetic valve 16 again is established, with thermocouple 32 in the meantime having cooled again, solenoid 44 is not supplied with electric energy. Furthermore, even if thermocouple 32 was still hot, the user first would have to push manual switch 18 so as to overcome the biasing force of spring 46 so as to bring valve element 20 sufficiently near to solenoid 44. Thus, without further action by the user, valve element 20 remains in the closed position in which it interrupts the connection between inlet line 22 and outlet line 24 so that burner nozzle 12 is not supplied with gas from manifold 14. Irrespective of whether the thermocouple 32 is hot, the initial position shown in FIG. 1 thus has been reached in which the burner nozzle 12 is not operative.

Figure 7:
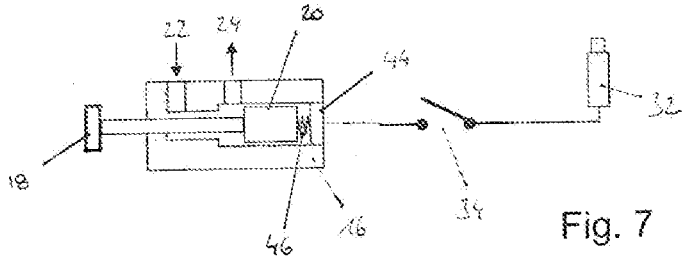

FIG. 7 shows the condition when manual switch 18 is pushed while cover element 36 is closed. With manual switch 18 being pressed down, valve element 20 is displaced into its open position in which inlet line 22 is connected to outlet line 24 so that gas is supplied from manifold 14 to burner nozzle 12. As long as push button 26 of switch 28 is not pressed, spark generator 30 is inactive and hence gas is ejected from burner nozzle 12 without being ignited. However, the gas flow will again be interrupted as soon as switch 18 is released, because due to cover element 36 being in its closed position, switching element 34 is opened so that solenoid 44 is de-energized and hence, when there is no longer a force acting on valve element 20, valve element 20 will be returned into the closed position by the action of spring 46.

Figure 8:
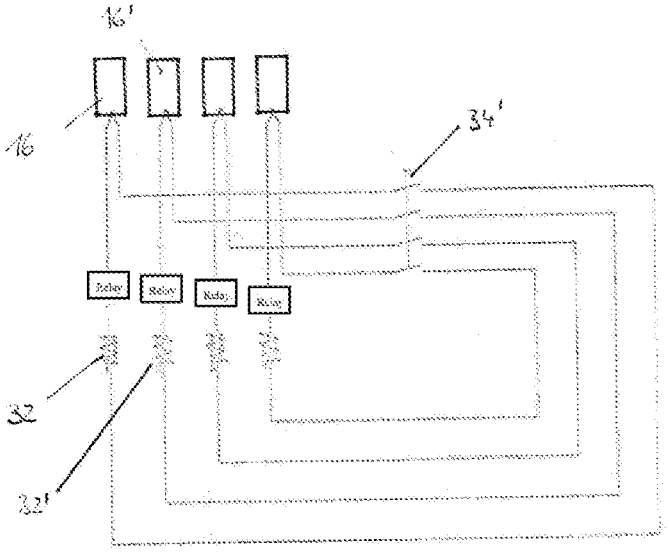
FIG. 8 is a simplified wiring scheme for a gas range comprising a plurality of gas burners.

FIG. 8 shows a simplified circuit layout for a gas range having four burner nozzles wherein to each of the burner nozzles there is associated an electromagnetic valve 16, 16' and a thermocouple 32, 32'. Since the gas supply to all burner nozzles shall be interrupted when the cover element 36 no longer is in the opened cooking position, switching element 34' is arranged to interrupt the connection between each of the electromagnetic valves 16, 16' and the respective thermocouple 32, 32' which is associated to the respective burner nozzle.

While by reference to FIG. 1 the present invention has been described in connection with a gas range comprising a pivotable cover element, it should be understood that the present invention similarly is applicable to any other kind of gas-fired kitchen appliance in which for normal operation of the kitchen appliance a cover element is to be brought into an operating position. Thus, in contrast to FIG. 1 wherein the cover element performs a rotary movement when it is displaced between its opened operation position and its closed position, the cover element also could perform a linear movement, such as a covering is plate for a gas range which is arranged to be laterally shifted between a first position in which the gas burner is exposed and a second position in which the covering plate covers the gas burner.

Furthermore, the present invention also is applicable not only to gas ranges, but also to other gas-fired kitchen appliances such as gas ovens in which the supply of gas to burner nozzles for heating the oven muffle is to be controlled in dependency of the position of the oven door.

Figure 9:
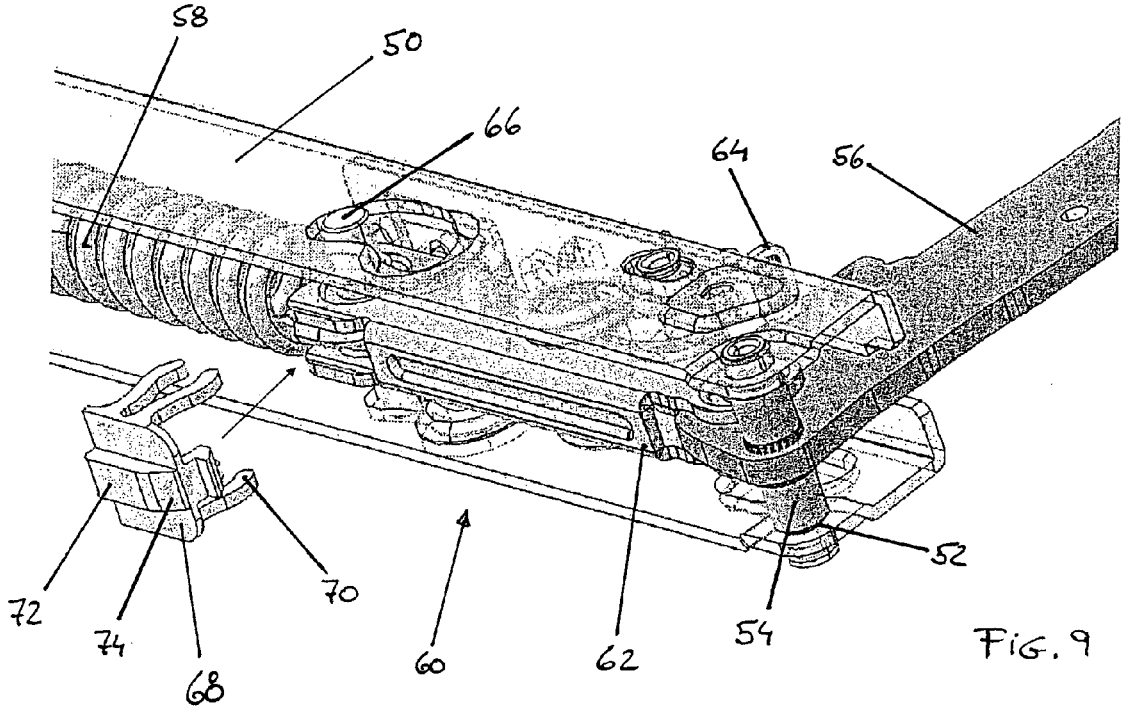
FIG. 9 is a perspective view of a hinge mechanism for a gas oven.
Figure 10:
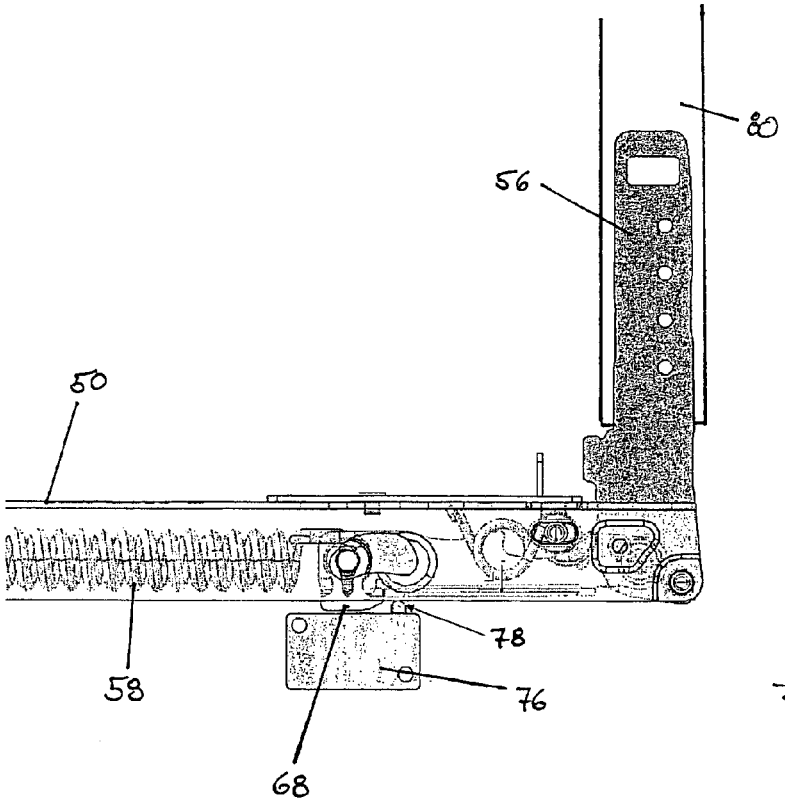
FIGS. 10 to 12 are schematic side views of the hinge mechanism shown in FIG. 9 in different operational positions.

FIGS. 9 to 12 illustrate a hinge mechanism for an oven door which is adapted to switch off the gas supply when the door is opened by a predetermined angle. As can be seen particularly in FIGS. 9 and 10, the hinge mechanism comprises a generally U-shaped mounting member 50 which is adapted for connection to the housing of a gas oven. Mounting member 50 comprises close to its front end a bearing journal 52 for the axle 54 of a hinge bracket 56 to which there is mounted the oven door (see door 80 in FIG. 10). In order to decelerate the door when opening the door, the hinge mechanism shown in FIGS. 9 to 12 comprises a balancing means comprising an extension spring 58 which is linked to hinge bracket 56 so as to be tensioned when the door is opened. In the embodiment shown in FIGS. 9 to 12, a quick release mechanism 60 is interconnected between hinge bracket 56 and extension spring 58. Quick release means 60 allows to remove the entire door 80 from the gas oven so as to facilitate cleaning thereof. As is illustrated in FIG. 9, quick release means 60 comprises a connector 62 which is hinged to hinge bracket 56 of the door. To activate quick release means 60, a lever 64 is tilted towards the opened door. When then the door is partially closed, lever 64 is engaged by a projection provided at hinge bracket 56 so as to activate the release mechanism. Since the release mechanism 60 as such is conventional, further description thereof will be omitted herein. However, it should be understood that when opening the oven door, connector 62 and hence axle 66 which is provided at the rear end of connector 62 and to which extension spring 58 is hooked, performs a substantially linear movement.

With the position of axle 66 thus being representative of the angular position of oven door 80 which is attached to hinge bracket 56, in order to implement the gas supply shut off function suggested herein, a clip 68 is provided which comprises flexible tongues 70 by means of which clip 68 can be attached to axle 66.

Clip 68 comprises a plateau surface 72 and a ramping surface 74 which merges into plateau surface 72. Plateau surface 72 and ramping surface 74 are adapted to operate a switching element 76 which is provided below mounting member 50. Switching element 76 comprises a push button 78 which when the oven door is opened is engaged by ramping surface 74 and plateau surface 72. In particular, when oven door 80 is in the closed position shown in FIG. 10, push button 78 of switching element 76 is in its extended position in which switching element 76 provides for an electrical connection between a thermocouple which is provided in proximity to a burner nozzle for heating the interior of the oven muffle and an electromagnetic valve which controls the supply of gas to such burner nozzle similar as it was explained above by reference to FIG. 1.

Figure 11:
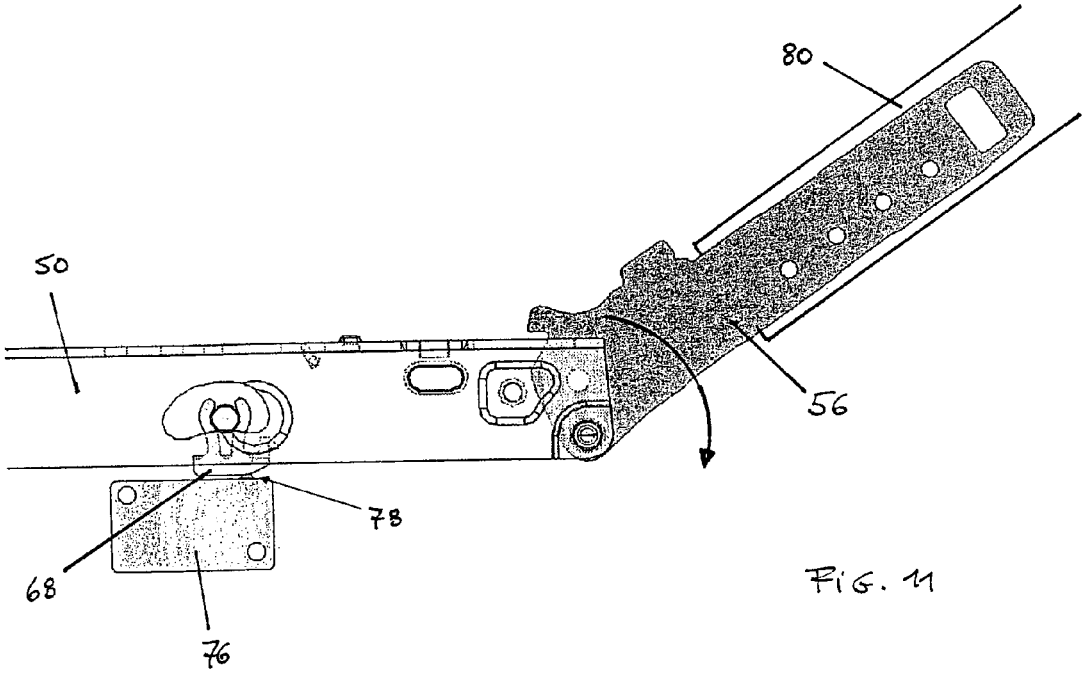

When during opening the oven door 80, as it is illustrated in FIG. 11, the door reaches a certain opening angle, ramping surface 74 of clip 68 engages push button 78 and thus pushes down push button 78 so that switching element 76 interrupts the supply of electric current from the thermocouple to the electromagnetic valve. Thus, the gas supply to the burner nozzle is shut off as it was explained above by reference to FIG. 5.

Figure 12:
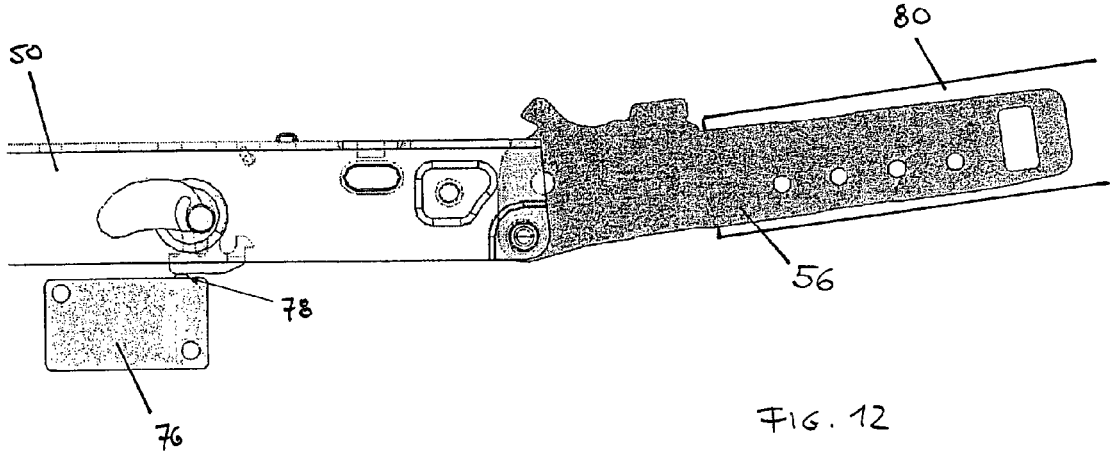

When further opening the door until door 80 reaches its fully opened position, as it is illustrated in FIG. 12, push button 78 is maintained in its pushed-down position by means of the plateau surface 72 so that switching element 76 continues interrupting the power supply to the electromagnetic valve.

It should be understood that by selecting an appropriate position of switching element 76 with respect to the path of movement of clip 68, it can be selected at which opening angle switching element 76 interrupts the power supply to electronic valve 16. Thus, if the arrangement shown in FIG. 10 shall be modified so as to cause switching element 76 to interrupt the power supply to electromagnetic valve 16 at a smaller opening angle of door 80, switching element 76 will be located further to the rear (in FIG. 10 further to the left) so that ramping surface 74 of clip 68 contacts push button 78 at a smaller opening angle of door 80.

REFERENCE SIGNS

10 cooking site
12 burner nozzle
14 manifold
16, 16' electromagnetic valve
18 manual switch
20 valve element
22 inlet line
24 outlet line
26 push button
28 switch
30 spark generator
32, 32' thermocouple
34, 34' switching element
36 cover element
38 cam member
40 push button
42 hinge
44 solenoid
46 spring
48 return spring
50 mounting member
52 bearing journal
54 axle
56 hinge bracket
58 extension spring
60 quick-release means
62 connector
64 lever
66 axle
68 clip
70 tongue
72 plateau surface
74 ramping surface
76 switching element
78 push button
80 oven door

The invention claimed is:

1. A gas-fired kitchen appliance, comprising:

(a) a food preparation zone;

(b) a burner nozzle for supplying heat to said food preparation zone;

(c) an electromagnetic valve which when energized allows gas to be supplied to the burner nozzle and which when de-energized blocks the gas supply to the burner nozzle, wherein the electromagnetic valve comprises a valve element for selectively opening and closing a supply line of the gas, a spring for biasing the valve element into the closed position, a manual switch arranged to move the valve element from the closed position to an opened position against the biasing force of the spring, and a solenoid which when energized maintains the valve element in the opened position;

(d) a thermocouple located in proximity of the burner nozzle, the thermocouple when heated energizing the electromagnetic valve;

(e) a cover element associated to said food preparation zone, said cover element being movable between a first position which allows normal operation of said food preparation zone and at least one second position in which said food preparation zone is closed or covered;

(f) a switching element associated to said cover element and arranged to interrupt the supply of electric energy from the thermocouple to the electromagnetic valve when the cover element is in said second position;

(g) a hinge mechanism connected to the cover element, wherein the hinge mechanism comprises a member which during movement of the cover element is subject to a linear movement; and (h) a clip having a plurality of opposed flexible fingers, the clip snapped to the member via the flexible fingers, wherein the clip is also subject to a linear movement, and wherein the clip comprises a slanted switching surface engaging a push button of said switching element, and wherein the linear movement of the member and the clip is perpendicular to a movement of the push button.

2. The kitchen appliance of claim 1, further comprising a gas regulator for adjusting the amount of gas supplied to the burner nozzle.

3. The kitchen appliance of claim 1, further comprising a spark generator located in proximity of the burner nozzle for ignition of a burner flame at said burner nozzle.

4. The kitchen appliance of claim 3, wherein said spark generator is coupled to said manual switch.

5. The kitchen appliance of claim 1, comprising a plurality of burner nozzles, to each of which there is associated an electromagnetic valve and a thermocouple wherein said switching element is arranged to interrupt the supply of electric energy from each of the thermocouples to the respective electromagnetic valve when the cover element is in said second position.

6. The kitchen appliance of claim 1, comprising a plurality of burner nozzles, to each of which there is associated an electromagnetic valve, a thermocouple, and a relay which is arranged in the line supplying electric energy from the thermocouple to the electromagnetic valve, wherein said switching element is arranged to trigger each of said relays to interrupt the supply of electric energy when said cover element is in said second position.

7. The kitchen appliance of claim 1, wherein said food preparation zone is a cooking site of a gas range, and said cover element is a cover plate for said cooking site.

8. The kitchen appliance of claim 7, wherein said cover plate is mounted so as to be pivotable between a substantially vertical operational position and a substantially horizontal non-operational position in which the cover plate covers the cooking site.

9. The kitchen appliance of claim 1, wherein said food preparation zone is a muffle of a gas oven, and said cover element is a door for said muffle.

10. The kitchen appliance of claim 9, wherein the supply of electric energy from the thermocouple to the electromagnetic valve is interrupted when the door reaches a certain angle.

11. The kitchen appliance of claim 1, wherein the clip is designed to be connected to said member of the hinge mechanism by a snap-on connection.

12. The kitchen appliance of claim 10, wherein the angle is less than 90° such that the supply of electric energy from the thermocouple to the electromagnetic valve is interrupted already before the door reaches its fully opened position.

13. The kitchen appliance of claim 10, wherein the angle is at least 45° to 60°.

14. The kitchen appliance of claim 1, wherein the slanted switching surface of the clip comprises a ramping section that merges into a plateau section.

15. The kitchen appliance of claim 14, wherein the push button is in an extended position when the cover element is in the first position, and the push button is in a pressed down position when the cover element is in the second position.

16. The kitchen appliance of claim 15, wherein the push button is in a pressed down position when the push button is in contact with either the ramping section or the plateau section of the slanted switching surface of the clip.

17. The kitchen appliance of claim 16, wherein supply of electric energy from the thermocouple to the electromagnetic valve is interrupted when the cover element reaches a certain angle, and wherein the angle is determined by the distance of the slanted switching surface of the clip and the push button when the cover element is in the first position.

* * * * *

UNITED STATES PATENT AND TRADEMARK OFFICE

CERTIFICATE OF CORRECTION

PATENT NO. : 9,243,806 B2
APPLICATION NO. : 13/640191
DATED : January 26, 2016
INVENTOR(S) : Cetintas et al.

It is certified that error appears in the above-identified patent and that said Letters Patent is hereby corrected as shown below:

In the specification:

Column 4, line 52: please delete the words "element so" and replace them with --element 34 so--

Column 5, line 5: please delete the words "spring which" and replace them with --spring 48 which--

Signed and Sealed this
Twelfth Day of July, 2016

Michelle K. Lee

Michelle K. Lee
*Director of the United States Patent and Trademark Office*